US011486686B2

(12) United States Patent
Hwang et al.

(10) Patent No.: US 11,486,686 B2
(45) Date of Patent: Nov. 1, 2022

(54) BLASTING SYSTEM INCLUDING ELECTRIC DETONATOR

(71) Applicant: HANWHA CORPORATION, Seoul (KR)

(72) Inventors: Ki Won Hwang, Boeun-gun (KR); Sung Ho Lee, Daejeon (KR)

(73) Assignee: HANWHA CORPORATION, Seoul (KR)

( * ) Notice: Subject to any disclaimer, the term of this patent is extended or adjusted under 35 U.S.C. 154(b) by 224 days.

(21) Appl. No.: 16/627,656

(22) PCT Filed: Dec. 12, 2019

(86) PCT No.: PCT/KR2019/017632
§ 371 (c)(1),
(2) Date: Dec. 30, 2019

(87) PCT Pub. No.: WO2020/130495
PCT Pub. Date: Jun. 25, 2020

(65) Prior Publication Data

US 2021/0356247 A1 Nov. 18, 2021

(30) Foreign Application Priority Data

Dec. 20, 2018 (KR) ..... 10-2018-0166552

(51) Int. Cl.
*G08C 17/02* (2006.01)
*F42D 1/055* (2006.01)

(52) U.S. Cl.
CPC ..... *F42D 1/055* (2013.01); *G08C 17/02* (2013.01)

(58) Field of Classification Search
CPC ..... F42D 1/055; G08C 17/02
See application file for complete search history.

(56) References Cited

U.S. PATENT DOCUMENTS 4,656,944 A * 4/1987 Gonzalez ..... F42D 1/06 102/209
5,295,438 A * 3/1994 Hill ..... F42D 1/055 102/217
6,079,333 A * 6/2000 Manning ..... F42D 1/05 102/420
7,568,429 B2 * 8/2009 Hummel ..... F42B 3/18 102/206
7,810,430 B2 * 10/2010 Chan ..... F42B 3/113 102/206
9,958,247 B2 * 5/2018 Teowee ..... F42D 1/05
(Continued)

FOREIGN PATENT DOCUMENTS

WO 2017/181207 A1 10/2017

*Primary Examiner* — Adnan Aziz
(74) *Attorney, Agent, or Firm* — WHDA, LLP

(57) ABSTRACT

Provided is a blasting system including a first detonator and a second detonator and a user terminal. The user terminal performs wireless communications with the first detonator and wired communications with the second detonator. Each of the first detonator and the second detonator includes an electric detonator storing detonator information, in which the electric detonator ignites an explosive in response to a blasting command, a connector connecting the electric detonator to the user terminal via a wireless or wired communication means, and a wiring portion connecting the electric detonator and the connector.

13 Claims, 6 Drawing Sheets

(56) References Cited

U.S. PATENT DOCUMENTS

| | | | | |
|---|---|---|---|---|
| 10,429,162 | B2 * | 10/2019 | Papillon | F42D 1/045 |
| 2003/0029344 | A1 * | 2/2003 | Eddy | F42D 1/055 102/200 |
| 2005/0103219 | A1 | 5/2005 | McClure et al. | |
| 2006/0027121 | A1 | 2/2006 | Koekemoer et al. | |
| 2009/0193993 | A1 * | 8/2009 | Hummel | F42D 1/055 901/50 |
| 2011/0067591 | A1 | 3/2011 | Stewart | |
| 2014/0053750 | A1 * | 2/2014 | Lownds | F42C 11/06 102/313 |
| 2014/0123866 | A1 * | 5/2014 | Givens | F42B 3/12 102/202.7 |
| 2017/0074625 | A1 * | 3/2017 | Appleby | F42D 1/055 |
| 2017/0074630 | A1 | 3/2017 | Kotsonis et al. | |
| 2017/0089680 | A1 * | 3/2017 | Papillon | F42D 5/00 |
| 2017/0328682 | A1 * | 11/2017 | Smith | G05D 1/107 |
| 2017/0328696 | A1 * | 11/2017 | Muller | F42D 1/05 |
| 2018/0231361 | A1 * | 8/2018 | Wicks | F42B 3/10 |
| 2019/0119066 | A1 * | 4/2019 | Muller | F42D 1/22 |
| 2020/0355483 | A1 * | 11/2020 | Laakko | F42D 1/055 |

* cited by examiner

BLASTING SYSTEM INCLUDING ELECTRIC DETONATOR

TECHNICAL FIELD

The present invention relates to a blasting system including an electric detonator and, more particularly, to a blasting system including an electric detonator performing communications with a user terminal selectively using a wireless network or a wired network.

BACKGROUND ART

In general, explosives are used in the field of engineering work, such as in rock blasting, in the demolition of waste buildings, and open air blasting. Specifically, a blasting target to be blasted is divided into a plurality of sections, and a plurality of holes into which explosives are inserted is drilled in each section. After explosives are inserted into the drilled holes, respectively, the explosives are connected to a user terminal. The explosives are ignited by operating the user terminal, thereby blasting the blasting target.

A wireless communication detonator or a wired communication detonator may be used as a detonator to ignite explosives.

In the related art, an electric detonator using wireless communications cannot be used in a wired blasting system, while an electric detonator using wired communications cannot be used in a wireless blasting system. Accordingly, operations are difficult and operating costs are increased, which are problematic.

DISCLOSURE

Technical Problem

Accordingly, the present invention has been made keeping in mind the above problems occurring in the prior art, and an objective of the present invention is to provide a blasting system including an electric detonator performing communications with a user terminal selectively using a wireless network or a wired network.

Another objective of the present invention is to provide a blasting system able to improve the convenience of operations.

Another objective of the present invention is to provide a blasting system able to reduce operating costs.

Technical Solution

In order to accomplish the above objective, embodiments of the present invention provide a blasting system including: a first detonator and a second detonator; and a user terminal performing wireless communications with the first detonator and performing wired communications with the second detonator. Each of the first detonator and the second detonator may include: an electric detonator storing detonator information, wherein the electric detonator ignites an explosive in response to a blasting command; a connector connecting the electric detonator to the user terminal via a wireless or wired communication means; and a wiring portion connecting the electric detonator and the connector.

The detonator information may include ignition initialization time information, blasting delay time information, identifier information, and position information.

The first detonator may further include a wireless communication device performing wireless communications with the user terminal device.

The first detonator may further include a cylindrical bobbin on which electric wires of the wiring portion are wound.

The wireless communication device may be fixedly coupled to one side of the bobbin.

The first detonator may further include a coupler fixing the wireless communication device to the bobbin.

The user terminal may transmit the blasting command to the first detonator via a wireless network and transmits the blasting command to the second detonator via a wired network.

The blasting system may further include a blasting device disposed between the user terminal device and the second detonator and connected to the user terminal device and the second detonator using a wired communication means.

The blasting system may further include a connector wiring portion connected to at least one of the wireless communication device, the blasting device, or a combination thereof.

The user terminal and the blasting device may be provided as being integrated.

In order to accomplish the above objective, embodiments of the present invention provide a blasting system including: a first detonator and a second detonator; and a user terminal performing wireless communications with the first detonator and performing wired communications with the second detonator. The user terminal may include: an initialization time setting module setting ignition initialization times for the first detonator and the second detonator; a locating module determining positions of the first detonator and the second detonator; an identification module identifying the first detonator and the second detonator; and a delay time setting module setting blasting delay times corresponding to the first detonator and the second detonator.

When the user terminal is synchronized with the first detonator and the second detonator, the initialization time setting module may set the ignition initialization times for the first detonator and the second detonator and transmit ignition initialization time information indicating the ignition initialization times to the first detonator and the second detonator.

When the user terminal is synchronized with the first detonator and the second detonator, the delay time setting module may set the blasting delay times for the first detonator and the second detonator.

When the user terminal is synchronized with the first detonator and the second detonator, the locating module may receive position information from the first detonator and the second detonator, and the identification module may receive identification information from the first detonator and the second detonator.

The user terminal may further include a blasting module transmitting a blasting command including the blasting delay times to the first detonator and the second detonator.

Advantageous Effects

As described above, the blasting system according to embodiments of the present invention may include an electric detonator performing communications with a user terminal selectively using a wireless network or a wired network.

In addition, the blasting system according to embodiments of the present invention may improve the convenience of operations.

In addition, the blasting system according to embodiments of the present invention may reduce operating costs.

The advantages obtainable from the present invention are not limited to the aforementioned advantages, and other advantages not explicitly disclosed herein will be clearly understood by those skilled in the art to which the present invention pertains from the description provided hereinafter.

DESCRIPTION OF THE REFERENCE NUMERALS IN THE DRAWINGS

Figure 1:
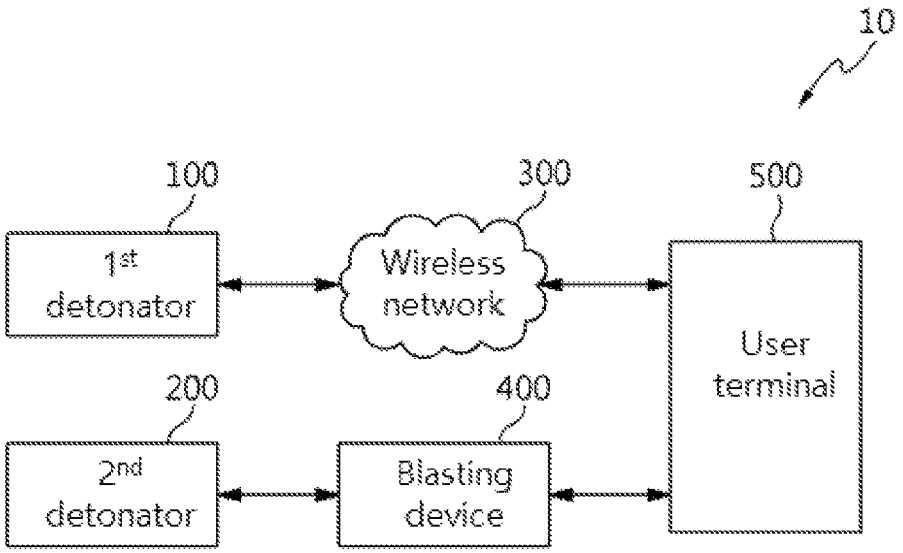
FIG. 1 is a diagram illustrating a blasting system according to embodiments of the present invention.

10: blasting system
100: first detonator
200: second detonator
300: wireless network
400: blasting device
500: user terminal

BEST MODE

Hereinafter, embodiments of the present invention and matters necessary for those skilled in the art to readily understand the features of the present invention will be described in detail with reference to the accompanying drawings. These embodiments are only provided for illustrative purposes, since the present invention may be implemented in a variety of different forms without departing from the scope of the present invention defined by the claims.

In the drawings, the same components will be designated by the same reference numerals. In addition, the thicknesses, ratios, and sizes of the components may be exaggerated for effective descriptions of technical features. The expression "and/or" includes any one or any combination of the mentioned items.

Terms such as "first" and "second" may be used herein to describe a variety of elements, and the elements should not be limited by the terms. The terms are only used to distinguish one element from other elements. Thus, a first element may be referred to as a second element, and similarly, a second element may be referred to as a first element. Singular forms used herein are intended to mean "one or more" unless the context clearly indicates otherwise.

Terms such as "below", "beneath", "under", "lower", "above", and "upper" may be used herein for ease of description of the relationship of an element to other elements as illustrated in the drawings. Such terms should be construed as describing relative relationships, and are used with respect to the orientations depicted in the drawings.

It will be further understood that the terms "comprise", "include", "have", etc. when used in this specification, specify the presence of stated features, integers, steps, operations, components, parts, and/or combinations thereof, but do not preclude the presence or addition of one or more other features, integers, steps, operations, components, parts, and/or combinations thereof.

That is, the present disclosure is not limited to the embodiments disclosed below, and may be realized in various other forms. It will be understood that when an element is referred to as being "connected" to another element, not only can it be directly connected to the other element, but it can also be electrically connected to the other element via an intervening element. In designating elements of the drawings by reference numerals, the same elements will be designated by the same reference numerals even when they are shown in different drawings.

FIG. 1 is a diagram illustrating a blasting system 10 according to embodiments of the present invention. Although the blasting system 10 is illustrated as including a first detonator 100 and a second detonator 200 herein for the sake of brevity, the present invention is not limited thereto. The first detonator 100 and the second detonator 200 represent a wireless communication electric detonator and a wired communication electric detonator, respectively. In some embodiments, the blasting system 10 may include three or more detonators.

Referring to FIG. 1, the blasting system 10 may include the first detonator 100, the second detonator 200, a wireless network 300, a blasting device 400, and a user terminal 500.

The first detonator 100 may be a wireless communication detonator that performs communications with the user terminal 500. The first detonator 100 may automatically synchronize with the user terminal 500 by performing wireless communications with the user terminal 500 via the wireless network 300. For example, when the first detonator 100 is synchronized with the user terminal 500, the first detonator 100 may receive ignition initialization time information from the user terminal 500 or may transmit identifier information and position information to the user terminal 500.

In addition, the first detonator 100 may receive a blasting command from the user terminal 500. The first detonator 100 may count a blasting delay time included in the blasting command, and when the counting is completed, may ignite an explosive.

The second detonator 200 may be a wired communication detonator that performs wired communications with the user terminal 500. Although not shown in FIG. 1, the second detonator 200 may perform wired communications with the user terminal 500 via separate cables (i.e. a wiring portion). The second detonator 200 may automatically synchronize with the user terminal 500 via wired communications. For example, when the second detonator 200 is synchronized with the user terminal 500, the second detonator 200 may receive the ignition initialization information from the user terminal 500 or may transmit identifier information and position information to the user terminal 500.

In addition, the second detonator 200 may receive the blasting command from the user terminal 500. The second detonator 200 may count a blasting delay time included in the blasting command, and when the counting is completed, may ignite the explosive.

The first detonator 100 may have a structure similar to that of the second detonator 200. Specifically, the first detonator 100 may further include a wireless communication device (not shown) to be connected to the wireless network 300, when compared to the second detonator 200. Details thereof will be described with reference to FIGS. 2 to 5.

The wireless network 300 may be implemented as any type of wireless network, such as a mobile radio communication network based on long-term evolution (LTE), a Bluetooth network, a Bluetooth network, a Wi-Fi network, a wireless broadband (Wibro) network, and a long range (LoRa) network.

The blasting device 400 may be disposed between the second detonator 200 and the user terminal 500. The blasting device 400 may supply power to the second detonator 200, or in response to the blasting command received from the user terminal 500, may deliver the blasting command to the second detonator 200. In some embodiments, the blasting device 400 may be omitted, and the second detonator 200 and the user terminal 500 may be directly connected via a wired communication means.

The user terminal 500 may perform communications with the first detonator 100 and the second detonator 200. Specifically, the user terminal 500 may perform communications with the first detonator 100 via a wired communication means. In addition, the user terminal 500 may synchronize with the first detonator 100 and the second detonator 200 by wireless or wired communications. For example, when the user terminal 500 synchronizes with the first detonator 100 and the second detonator 200, the user terminal 500 may transmit the ignition initialization time information or receive the identifier information and the position information from the first detonator 100 and the second detonator 200.

In addition, the user terminal 500 may transmit the blasting command, including blasting delay times for the first detonator 100 and the second detonator 200, to the first detonator 100 and the second detonator 200.

In some embodiments, the blasting device 400 and the user terminal 500 may be integrated into a single component.

Figure 2:
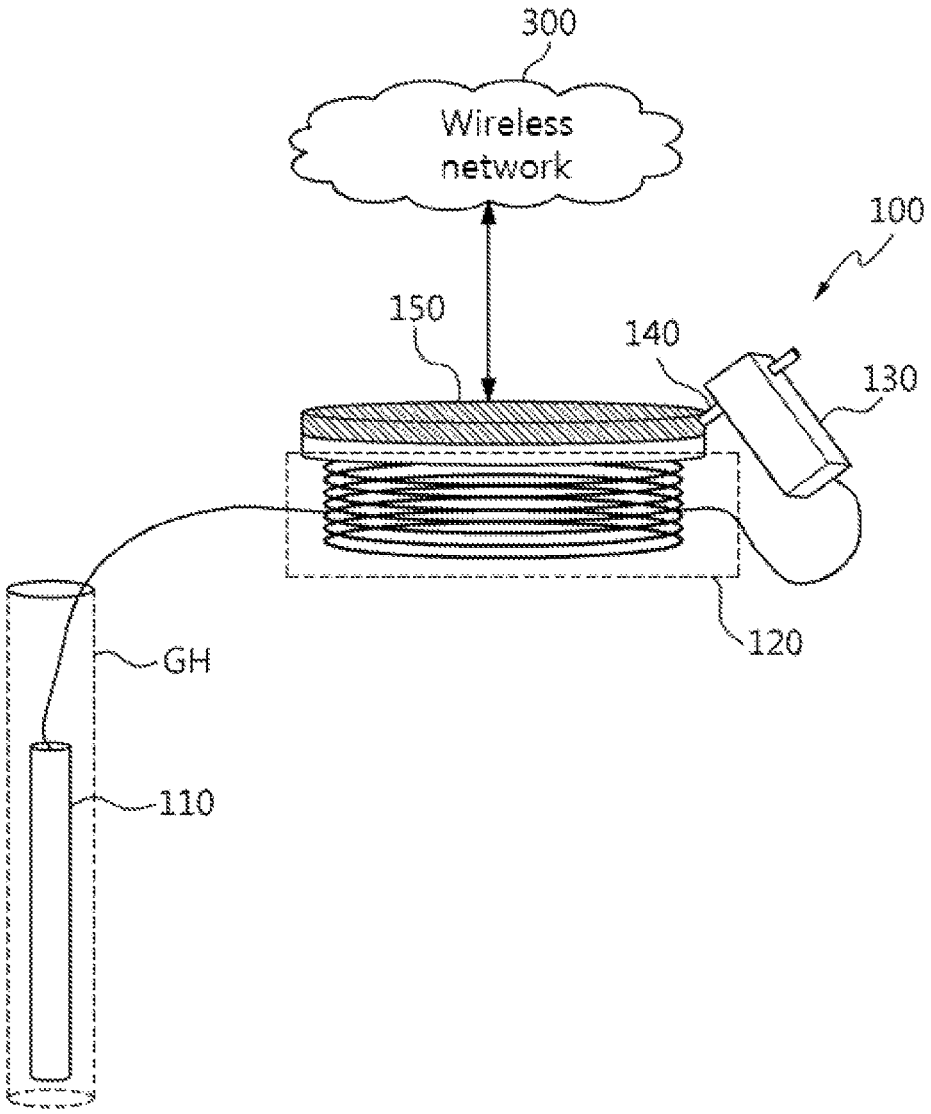
FIG. 2 is a diagram illustrating the first detonator according to an embodiment of the present invention.

FIG. 2 is a diagram illustrating the first detonator 100 according to an embodiment of the present invention.

Referring to FIGS. 1 and 2, the first detonator 100 may include an electric detonator 110, wiring portions 120, a connector 130, a connector wiring portion 140, and a wireless communication device 150.

The electric detonator 110 may be located within a blasting hole GH. In addition, when the blasting command is received via the wiring portions 120, the electric detonator 110 may ignite to ignite the explosive located close thereto. The electric detonator 110 may include a storage to store detonator information. For example, the detonator information may include ignition initialization time information, blasting delay time information, identifier information, and position information.

The wiring portions 120 may connect the electric detonator 110 and the connector 130. For example, the wiring portions 120 may transmit the blasting command including the blasting delay times to the electric detonator 110 or transmit the identifier information and position information, stored in the electric detonator 110, to the connector 130.

The connector 130 may selectively connect the electric detonator 110 to the user terminal 500 by a wireless or wired means. Details thereof may vary depending on embodiments and will be described below.

The connector 130 may connect the wiring portions 120 and the connector wiring portion 140. For example, the connector 130 may protect a connecting portion between the wiring portions 120 and the connector wiring portion 140 from the external environment (i.e. moisture, water, and the like).

The connector wiring portion 140 may be connected to the connector 130, and may be electrically connected to the wiring portions 120 via the connector 130. In addition, the connector wiring portion 140 may connect the connector 130 and the wireless communication device 150. In some embodiments, the connector wiring portion 140 may be provided as a portion of the wiring portions 120.

The wireless communication device 150 may perform communications with the user terminal 500 via the wireless network 300. For example, the wireless communication device 150 may be implemented as a communication module corresponding to the wireless network 300. The wireless communication device 150 may transmit the detonator information, stored in the electric detonator 110, to the user terminal 500 via the wireless network 300 or may receive the blasting command from the user terminal 500.

The wireless communication device 150 may be implemented as a variety of shapes, and in particular, may have the shape of a disc or doughnut such that the first detonator 100 may be easily disposed or moved when inserted into the blasting hole GH.

Figure 3:
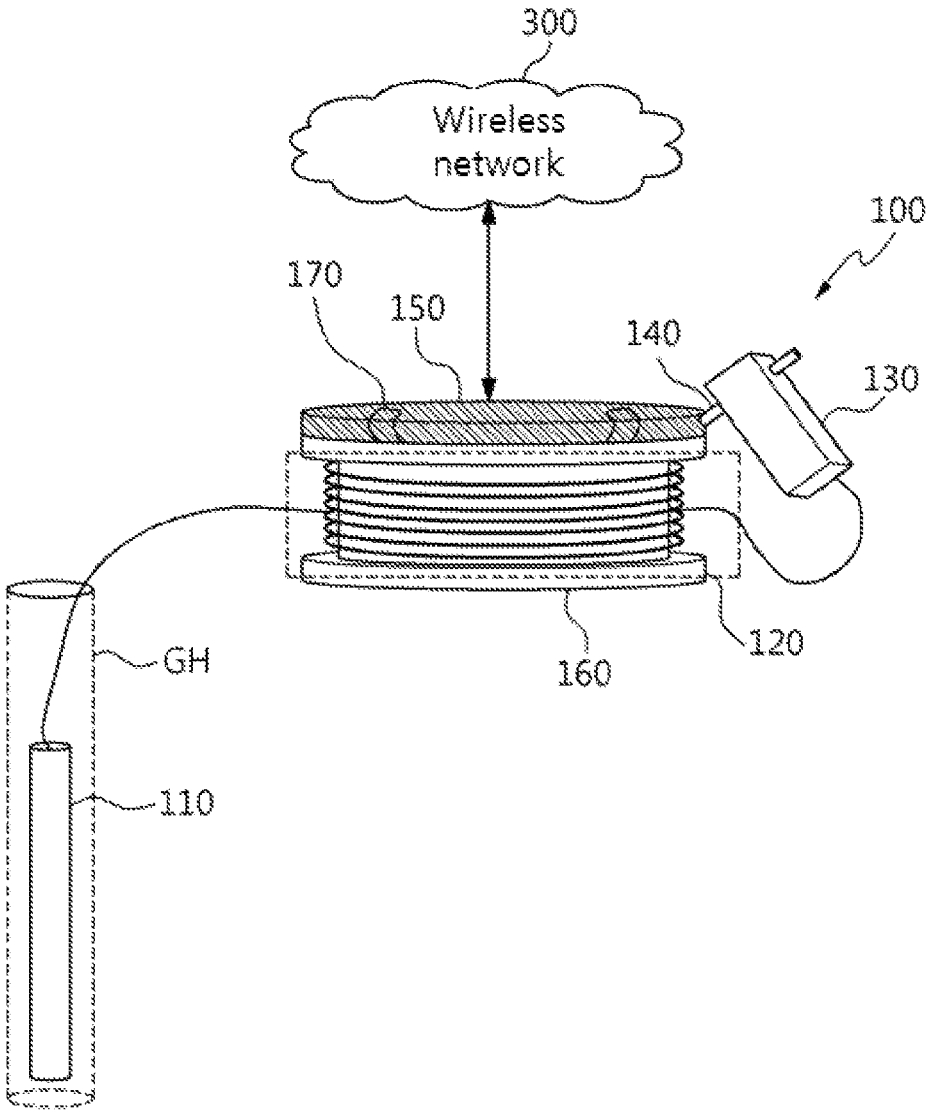
FIG. 3 is a diagram illustrating the first detonator according to an embodiment of the present invention.

FIG. 3 is a diagram illustrating the first detonator 100 according to an embodiment of the present invention. To avoid repeated descriptions, features different from those of the first detonator 100 according to the embodiment illustrated in FIG. 2 will mainly be described.

Referring to FIGS. 1 to 3, the first detonator 100 may include the electric detonator 110, the wiring portions 120, the connector 130, the connector wiring portion 140, the wireless communication device 150, a bobbin 160, and a coupler 170. That is, the first detonator 100 illustrated in FIG. 3 may further include the bobbin 160 and the coupler 170, compared to the first detonator 100 illustrated in FIG. 2.

The electric detonator 110 may be located within the blasting hole GH to blast the explosive in response to the blasting command.

The wiring portions 120 may be electric wires by which the electric detonator 110 and the connector 130 are connected. For example, the wiring portions 120 may be wound on the cylindrical bobbin 160.

The connector 130 may selectively connect the electric detonator 110 to the user terminal 500 via a wireless or wired communication means. Details thereof may vary depending on embodiments and will be described below.

The connector 130 may connect the wiring portions 120 to the connector wiring portion 140. For example, the connector 130 may protect a connecting portion between the wiring portions 120 and the connector wiring portion 140 from the external environment (i.e. moisture, water, and the like).

The connector wiring portion 140 may be connected to the connector 130, and may be electrically connected to the wiring portions 120 via the connector 130. In addition, the connector wiring portion 140 may connect the connector 130 and the wireless communication device 150. In some embodiments, the connector wiring portion 140 may be provided as a portion of the wiring portions 120.

The wireless communication device 150 may perform communications with the user terminal 500 via the wireless network 300. The wireless communication device 150 may be fixedly coupled to one side of the bobbin 160. The wireless communication device 150 may be provided in a shape corresponding to the bobbin 160 so as to be easily coupled to the bobbin 160. For example, the wireless communication device 150 may have the shape of a disc or doughnut corresponding to the bobbin 160.

The bobbin 160 may be coupled to the wiring portions 120, with the wiring portions 120 being wound on the bobbin 160. In addition, the bobbin 160 may be coupled to the wireless communication device 150. Accordingly, when the first detonator 100 including the bobbin 160 may be easily disposed or moved when inserted into the blasting hole GH.

The coupler 170 may couple the wireless communication device 150 to the bobbin 160. For example, the coupler 170 may have the shape of a ring or a clasp, and may fix the wireless communication device 150 to the bobbin so that the wireless communication device 150 is not movable on one side of the bobbin 160.

Figure 4:
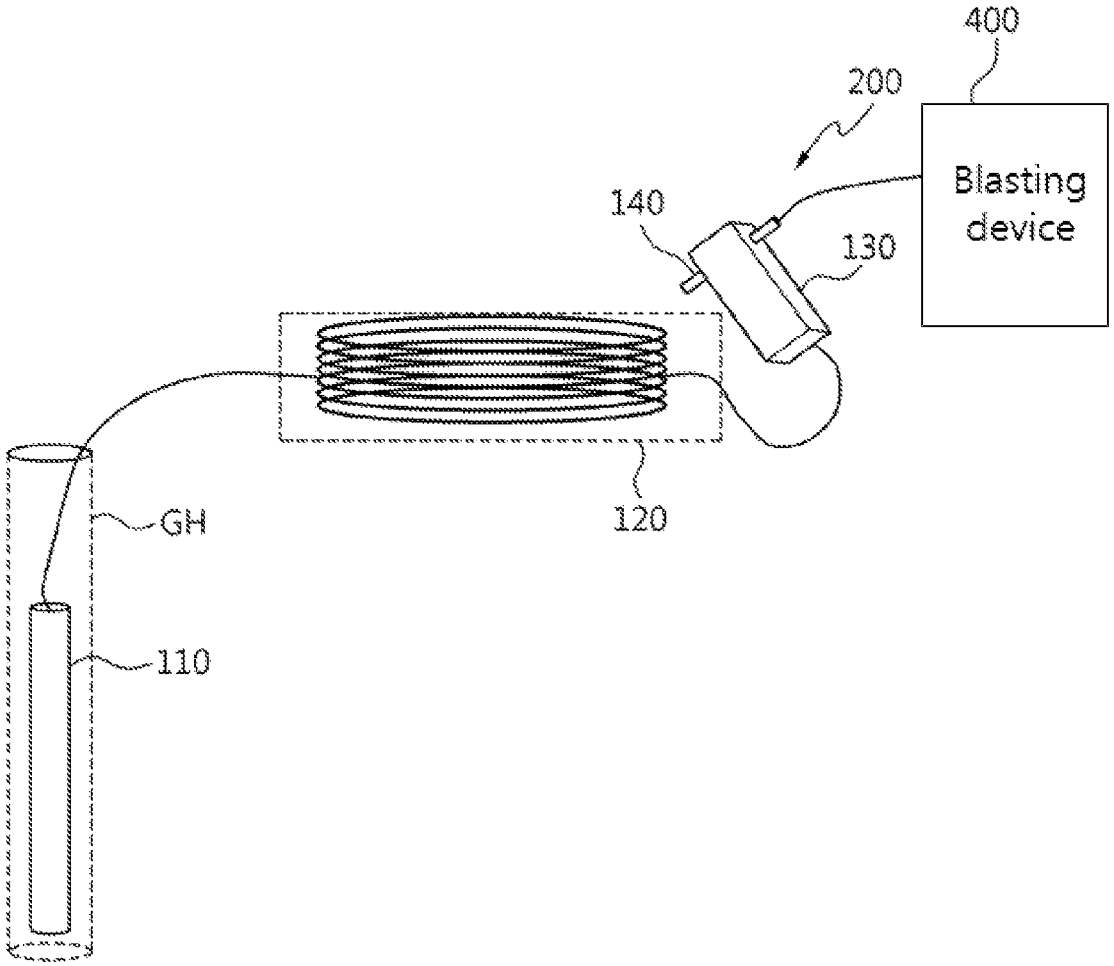
FIG. 4 is a diagram illustrating the second detonator according to an embodiment of the present invention.

FIG. 4 is a diagram illustrating the second detonator 200 according to an embodiment of the present invention. To avoid repeated descriptions, features different from those of the first detonator 100 according to the embodiment illustrated in FIG. 2 will mainly be described.

With reference to FIGS. 1 to 4, the second detonator 200 may include the electric detonator 110, the wiring portions 120, the connector 130, and the connector wiring portion 140. That is, the second detonator 200 illustrated in FIG. 4 does not include the wireless communication device 150, differently from the first detonator 100 illustrated in FIG. 2.

The electric detonator 110 of the second detonator 200 may be located within the blasting hole GH, and may ignite the explosive in response to the blasting command.

The wiring portions 120 may be electric wires by which the electric detonator 110 and the connector 130 are connected.

The connector 130 may selectively connect the electric detonator 110 to the user terminal 500 by a wireless or wired means. Details thereof may vary depending on embodiments and will be described below.

The connector 130 may connect the wiring portions 120 to the connector wiring portion 140. For example, the connector 130 may protect a connecting portion between the wiring portions 120 and the connector wiring portion 140 from the external environment (i.e. moisture, water, and the like).

The connector wiring portion 140 may be connected to the connector 130, and may be electrically connected to the wiring portions 120 via the connector 130. The connector wiring portion 140 may include electric wires connected to the blasting device 400. In some embodiments, the connector wiring portion 140 may be provided as a portion of the wiring portions 120.

The second detonator 200 may perform wired communications with the blasting device 400 and the user terminal 500 via the connector wiring portion 140 connected to the blasting device 400.

In some embodiments, when the blasting device 400 is omitted, the second detonator 200 may be connected to the user terminal 500 via the connector wiring portion 140.

That is, the first detonator 100 illustrated in FIG. 2 has a structure with which the wireless communication device 150 is added to the second detonator 200 illustrated in FIG. 4, such that the first detonator 100 is connected to the electric detonator 110 via the connector 130. Accordingly, the first detonator 100 may be selectively implemented from the second detonator 200.

Figure 5:
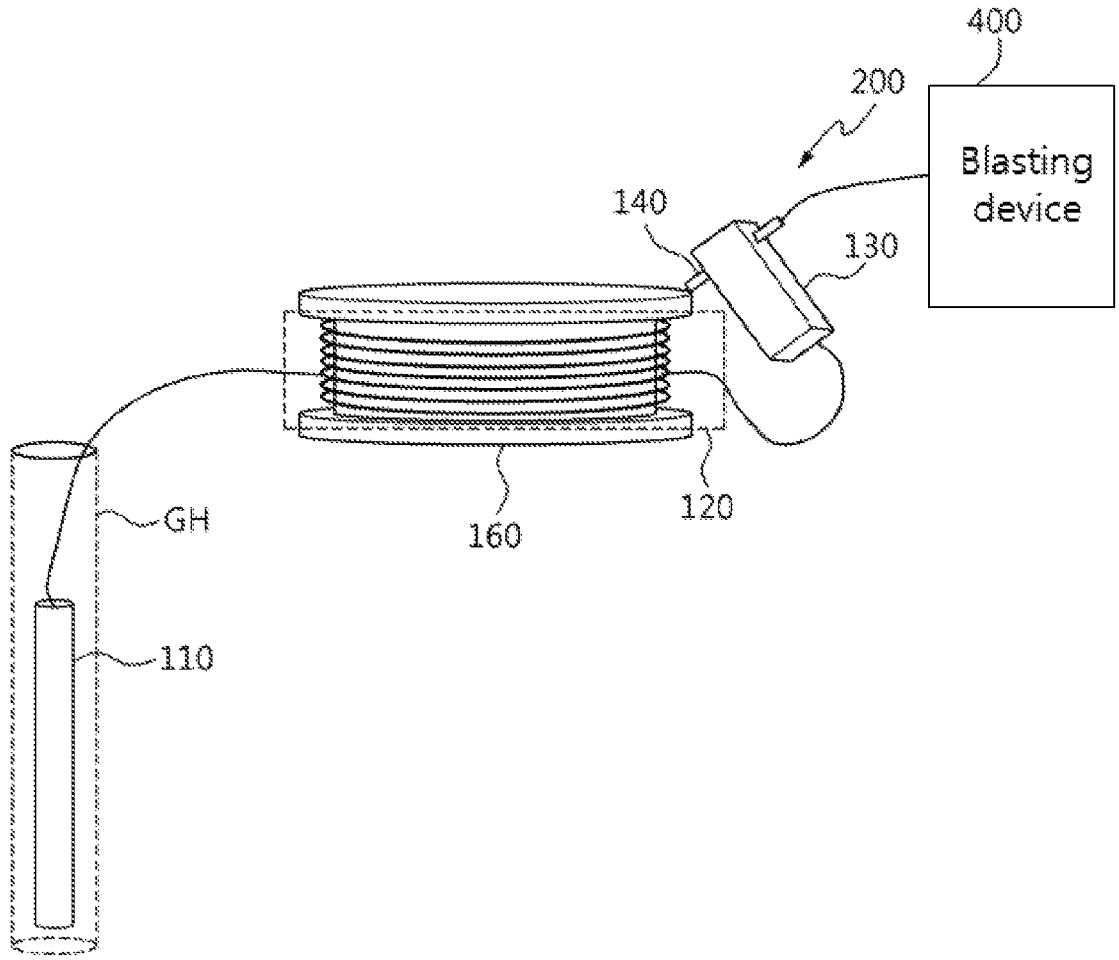
FIG. 5 is a diagram illustrating the second detonator according to an embodiment of the present invention.

FIG. 5 is a diagram illustrating the second detonator 200 according to an embodiment of the present invention. To avoid repeated descriptions, features different from those of the first detonator 100 according to the embodiment illustrated in FIG. 4 will mainly be described.

Referring to FIGS. 1 to 5, the first detonator 100 may include the electric detonator 110, the wiring portions 120, the connector 130, the connector wiring portion 140, and the bobbin 160. That is, the second detonator 200 illustrated in FIG. 5 may further include the bobbin 160, compared to the second detonator 200 illustrated in FIG. 4.

The electric detonator 110 may be located within the blasting hole GH to ignite the explosive in response to the blasting command.

The wiring portions 120 may be electric wires by which the electric detonator 110 and the connector 130 are connected. For example, the wiring portions 120 may be wound on the cylindrical bobbin 160.

The connector 130 may selectively connect the electric detonator 110 to the user terminal 500 via a wireless or wired communication means. Details thereof may vary depending on embodiments and will be described below.

The connector 130 may connect the wiring portions 120 to the connector wiring portion 140. For example, the connector 130 may protect a connecting portion between the wiring portions 120 and the connector wiring portion 140 from the external environment (i.e. moisture, water, and the like).

The connector wiring portion 140 may be connected to the connector 130, and may be electrically connected to the wiring portions 120 via the connector 130. In addition, the connector wiring portion 140 may include electric wires connected to the blasting device 400. In some embodiments, the connector wiring portion 140 may be provided as a portion of the wiring portions 120.

The second detonator 200 may perform wired communications with the blasting device 400 and the user terminal 500 via the connector wiring portion 140 connected to the blasting device 400.

The bobbin 160 may be coupled to the wiring portions 120, with the wiring portions 120 being wound on the bobbin 160. Accordingly, when the second detonator 200 including the bobbin 160 may be easily disposed or moved when inserted into the blasting hole GH.

Figure 6:
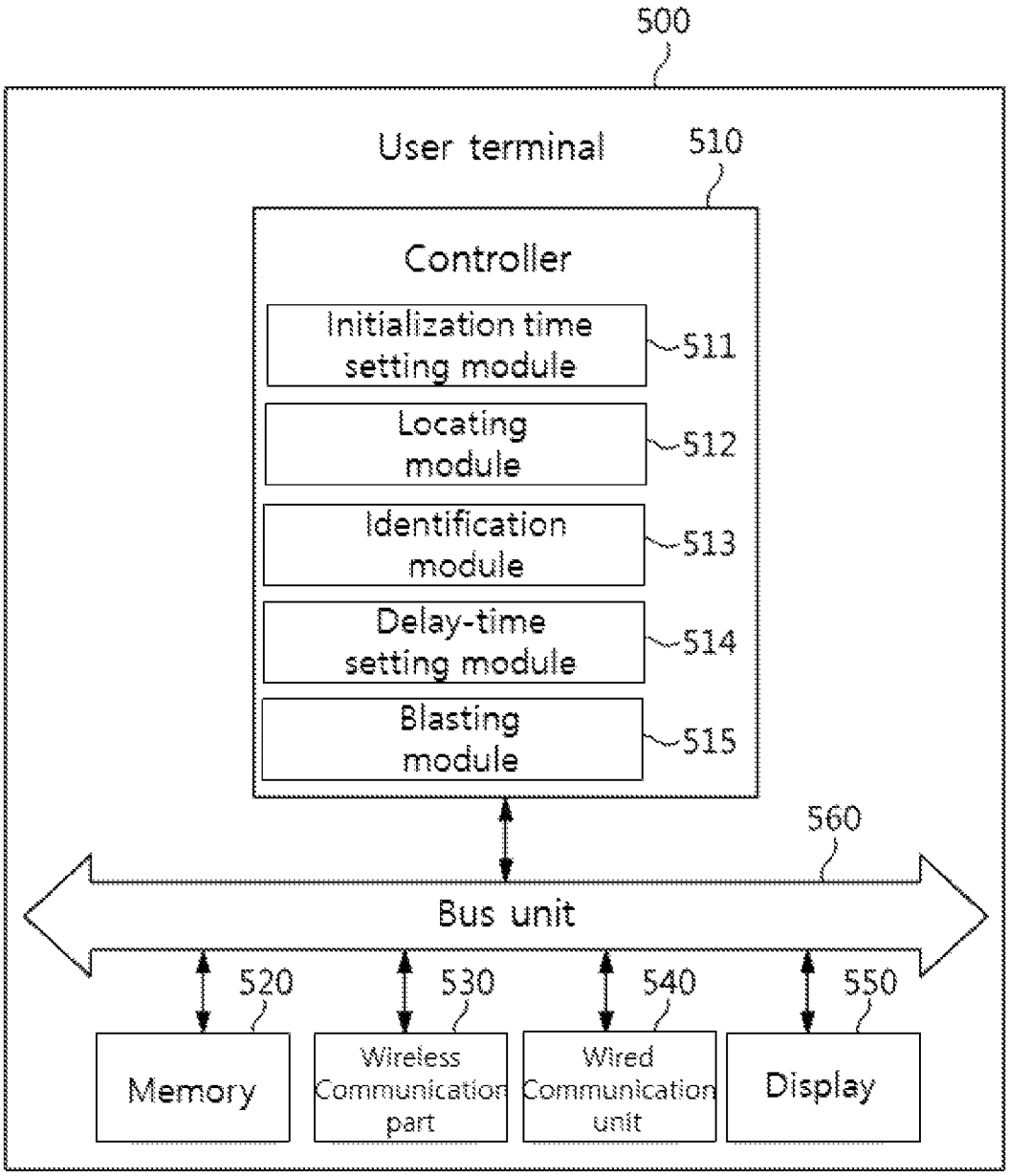
FIG. 6 is a diagram illustrating the user terminal according to an embodiment of the present invention.

FIG. 6 is a diagram illustrating the user terminal 500 according to an embodiment of the present invention.

Referring to FIGS. 1 to 6, the user terminal 500 may include a controller 510, a memory 520, a wireless communication part 530, a display 550, and a bus 560.

The controller 510 may control the overall operation of the user terminal 500. In some embodiments, the controller 510 may be implemented as a central processing unit (CPU), a microprocessor unit (MPU), a graphics processing unit (GPU), or the like.

The memory 520 may store, therein, a plurality of commands of a program executable by the controller 510, data regarding a list of parts, and data regarding characteristics of parts. In some embodiments, the memory 520 may be implemented as a read only memory (ROM), a random access memory (RAM), a hard disk drive (HDD), a solid state drive (SSD), or the like.

The wireless communication part 530 may perform communications with the user terminal 500 and the first detonator 100. For example, the wireless communication part 530 may perform communications with the first detonator 100 via the wireless network 300. In some embodiments, the wireless communication part 530 may be implemented as any type of wireless network, such as a mobile radio communication network based on long-term evolution (LTE), a Bluetooth network, a Bluetooth network, a Wi-Fi network, a wireless broadband (Wibro) network, and a long range (LoRa) network.

The wired communication part 540 may perform communications with the user terminal 500 and the second detonator 200. For example, the wired communication part 540 may perform communications with at least one of the second detonator 200 and the blasting device 400 via separate electric wires. In some embodiments, the wired communication part 540 may perform communications using any type of wired network, such as a local area network (LAN) or a wide area network (WAN).

The display 550 may display images. For example, the display 550 may be implemented as a display panel. In some embodiments, the display 550 may be implemented as a liquid crystal display (LCD) device or an organic light-emitting display (OLED) device. However, the present invention is not limited thereto, and the display 550 may be implemented as a variety of devices as long as the purpose of displaying images can be complied. The display 550 may display the first detonator 100 and the second detonator 200 on a map, on the basis of the identifier information and the position information received from the first detonator 100 and the second detonator 200.

The bus 560 may allow data to be transmitted among the controller 510, the memory 520, the wireless communication part 530, the wired communication part 540, and the display 550. In some embodiments, the bus 560 may be implemented as a bus interface.

The controller 510 may include an initialization time setting module 511, a locating module 512, an identification module 513, a delay time setting module 514, and a blasting module 515. Herein, the term "module" may be software (or a program) in which commands constituting a program stored in the memory 520 are executed by the controller 510.

The initialization time setting module 511 may set an ignition initialization time corresponding to the first detonator 100 and the second detonator 200. When the user terminal 500 synchronizes the first detonator 100 and the second detonator 200, the initialization time setting module 511 may set the ignition initialization time and transmit ignition initialization time information indicating the ignition initialization time to the first detonator 100 and the second detonator 200 via the wireless communication part 530 and wired communication part 540.

The locating module 512 may determine the positions of the first detonator 100 and the second detonator 200. When the user terminal 500 is synchronized with the first detonator 100 and the second detonator 200, the locating module 512 may receive the position information from the first detonator 100 and the second detonator 200 via the wireless communication part 530 and the wired communication part 540. In addition, the locating module 512 may determine the positions of the first detonator 100 and the second detonator 200 using the position information.

The identification module 513 may identify the first detonator 100 and the second detonator 200. When the user terminal 500 is synchronized with the first detonator 100 and the second detonator 200, the identification module 513 may receive the identification information from the first detonator 100 and the second detonator 200 via the wireless communication part 530 and the wired communication part 540. In addition, the identification module 513 may identify the first detonator 100 and the second detonator 200 using the identification information.

The delay time setting module 514 may set the blasting delay times for the first detonator 100 and the second detonator 200. For example, the blasting delay times may be set in consideration of communication delay times, deviations, and the like. The delay time setting module 514 may set the blasting delay times when the user terminal 500 is synchronized with the first detonator 100 and the second detonator 200.

The blasting module 515 may transmit the blasting command, including the blasting delay times set by the delay time setting module 514, to the first detonator 100 and the second detonator 200. For example, the blasting module 515 may transmit the blasting command to the first detonator 100 and the second detonator 200 via the wireless communication part 530 and the wired communication part 540. The first detonator 100 and the second detonator 200 may store, therein, the blasting delay time information indicating the blasting delay times included in the received blasting command.

Although the exemplary embodiments of the present invention have been described for illustrative purposes, those skilled in the art or those having ordinary knowledge in the art will appreciate that various modifications, additions and substitutions are possible without departing from the scope and spirit of the present invention as disclosed in the accompanying claims.

Therefore, the technical scope of the present invention is not limited to the exemplary embodiments described herein, but should be determined on the basis of the claims.

The invention claimed is:

1. A blasting system comprising:

a first detonator and a second detonator; and a user terminal performing wireless communications with the first detonator and performing wired communications with the second detonator, wherein each of the first detonator and the second detonator includes:

an electric detonator storing detonator information, wherein the electric detonator ignites an explosive in response to a blasting command;

a connector connecting the electric detonator to the user terminal via a wireless or wired communication means; and a wiring portion connecting the electric detonator and the connector, wherein the first detonator further includes a wireless communication device performing wireless communications with the user terminal, wherein the first detonator further includes a cylindrical bobbin on which electric wires of the wiring portion are wound, wherein the wireless communication device has the shape of a disc or doughnut corresponding to the cylindrical bobbin, and wherein the connector selectively connects the electric detonator to the user terminal by the wireless or wired communication means.

2. The blasting system according to claim 1, wherein the detonator information includes ignition initialization time information, blasting delay time information, identifier information, and position information.

3. The blasting system according to claim 1, wherein the wireless communication device is fixedly coupled to one side of the bobbin.

4. The blasting system according to claim 3, wherein the first detonator further includes a coupler fixing the wireless communication device to the bobbin.

5. The blasting system according to claim 1, wherein the user terminal transmits the blasting command to the first detonator via a wireless network and transmits the blasting command to the second detonator via a wired network.

6. The blasting system according to claim 5, further comprising a blasting device disposed between the user terminal and the second detonator and connected to the user terminal and the second detonator using a wired communication means.

7. The blasting system according to claim 6, further comprising a connector wiring portion connected to at least one of the wireless communication device, the blasting device, or a combination thereof.

8. The blasting system according to claim 7, wherein the user terminal and the blasting device are provided as being integrated.

9. A blasting system comprising:

a first detonator and a second detonator; and a user terminal performing wireless communications with the first detonator and performing wired communications with the second detonator, wherein each of the first detonator and the second detonator includes:

an electric detonator storing detonator information, wherein the electric detonator ignites an explosive in response to a blasting command;

a connector connecting the electric detonator to the user terminal via a wireless or wired communication means; and a wiring portion connecting the electric detonator and the connector, wherein the user terminal includes:

an initialization time setting module setting ignition initialization times for the first detonator and the second detonator;

a locating module determining positions of the first detonator and the second detonator;

an identification module identifying the first detonator and the second detonator; and a delay time setting module setting blasting delay times corresponding to the first detonator and the second detonator, wherein the first detonator further includes a wireless communication device performing wireless communications with the user terminal, wherein the first detonator further includes a cylindrical bobbin on which electric wires of the wiring portion are wound, wherein the wireless communication device has the shape of a disc or doughnut corresponding to the cylindrical bobbin, and wherein the connector selectively connects the electric detonator to the user terminal by the wireless or wired communication means.

10. The blasting system according to claim 9, wherein, when the user terminal is synchronized with the first detonator and the second detonator, the initialization time setting module sets the ignition initialization times for the first detonator and the second detonator and transmits ignition initialization time information indicating the ignition initialization times to the first detonator and the second detonator.

11. The blasting system according to claim 9, wherein, when the user terminal is synchronized with the first detonator and the second detonator, the delay time setting module sets the blasting delay times for the first detonator and the second detonator.

12. The blasting system according to claim 9, wherein, when the user terminal is synchronized with the first detonator and the second detonator, the locating module receives position information from the first detonator and the second detonator, and the identification module receives identification information from the first detonator and the second detonator.

13. The blasting system according to claim 10, wherein the user terminal further includes a blasting module transmitting a blasting command including the blasting delay times to the first detonator and the second detonator.

* * * * *